US006758657B1

(12) United States Patent
McNaull et al.

(10) Patent No.: US 6,758,657 B1
(45) Date of Patent: Jul. 6, 2004

(54) ELECTROMAGNETICALLY DRIVEN DIAPHRAGM PUMP

(75) Inventors: Michael H. McNaull, Ashland, OH (US); Mason B. Mount, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 35 days.

(21) Appl. No.: 10/174,781

(22) Filed: Jun. 20, 2002

(51) Int. Cl.[7] ..... F04B 17/00; F01B 31/14

(52) U.S. Cl. ..... 417/413.1; 417/44.1; 417/415; 92/60.5

(58) Field of Search ..... 417/413.1, 410.1, 417/423.7, 423.14, 415, 44.1, 416, 417, 18; 92/60.5, 130 C

(56) References Cited

U.S. PATENT DOCUMENTS 1,802,136 A * 4/1931 Carter ..... 417/413.1
1,926,074 A * 9/1933 Warnke ..... 417/413.1
4,309,153 A * 1/1982 Panick et al. ..... 417/252
4,370,107 A * 1/1983 Landis et al. ..... 417/413.1
4,832,582 A * 5/1989 Buffet ..... 417/413.1
6,568,926 B1 * 5/2003 Mount ..... 417/568

* cited by examiner

*Primary Examiner*—Justine R. Yu
*Assistant Examiner*—Michael K. Gray
(74) *Attorney, Agent, or Firm*—Renner, Kenner, Greive, Bobak, Taylor & Weber

(57) ABSTRACT

A pump (10) has a housing which forms a pump chamber (17) having a wall (18). Inlet and outlet valve assemblies (19, 20) communicate with the chamber (17) and, respectively, allow fluid to be received in, and discharged from, the chamber (17). An armature (27) carries a plunger (28) and is reciprocatably moved by an electromagnetic coil assembly (25). A coil spring (44) biases the plunger (28) toward a stop surface (41) positioned adjacent to the plunger (28). Upon activation of the coil assembly (25), the plunger. (28) is moved against the force of the spring (44) such that a diaphragm (31) carried by the plunger (28) moves into the chamber (17) without engaging the wall (18) to discharge fluid through the outlet valve assembly (20). When the coil assembly (25) is deactivated, the spring (44) moves the plunger (28) toward the stop surface (41) without allowing it to engage the stop surface (41) to draw fluid in through the inlet valve assembly (19). In another embodiment, a second coil spring (45) is positioned so as to bias the plunger (28) away from the stop surface (41) to prevent the plunger (28) from engaging the stop surface (41) during priming of the pump (10).

15 Claims, 4 Drawing Sheets

ELECTROMAGNETICALLY DRIVEN DIAPHRAGM PUMP

TECHNICAL FIELD

This invention relates to an electromagnetically driven diaphragm pump. More particularly, this invention relates to such a pump which provides a continuous low flow of fluid at a high pressure.

BACKGROUND ART

Oscillating pumps such as that shown in U.S. Pat. No. 5,915,930 are well known in the art, but they lack accuracy when a low flow rate is desired. Those pumps which can provide accuracy in low flow/high pressure applications are noisy because the pumping element moves from seat to seat, thereby generating noise at each end of the stroke. Moreover, these pumps require multiple seals to the atmosphere and cannot always be designed to be compact.

DISCLOSURE OF THE INVENTION

It is thus an object of the present invention to provide an electromagnetically driven diaphragm pump for continuous low flow, high pressure applications.

It is another object of the present invention to provide a pump, as above, which is quiet during operation.

It is a further object of the present invention to provide a pump, as above, in which the diaphragm seals the pump chamber.

It is an additional object of the present invention to provide a pump, as above, which is compact and economically manufactured.

These and other objects of the present invention, as well as the advantages thereof over existing prior art forms, which will become apparent from the description to follow, are accomplished by the improvements hereinafter described and claimed.

In general, a pump made in accordance with the present invention includes a housing having a pump chamber defined by at least one wall. An inlet area includes a valve which allows fluid to be received in the chamber, and an outlet area includes a valve which allows fluid to be discharged from the chamber. An armature carries a plunger, and a stop surface is positioned adjacent to one end of the plunger. Means are provided to bias the plunger toward the stop surface. A diaphragm which seals the chamber is carried by the other end of the plunger. An electromagnetic coil is provided which, when activated, moves the armature to overcome the force of the means to bias so that the diaphragm is moved into the chamber without engaging the wall of the chamber to discharge fluid through the outlet area. Upon deactivation of the coil, the means to bias moves the plunger toward the stop surface but the plunger does not engage the stop surface as fluid is drawn in through the inlet area and into the chamber.

A preferred exemplary pump incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
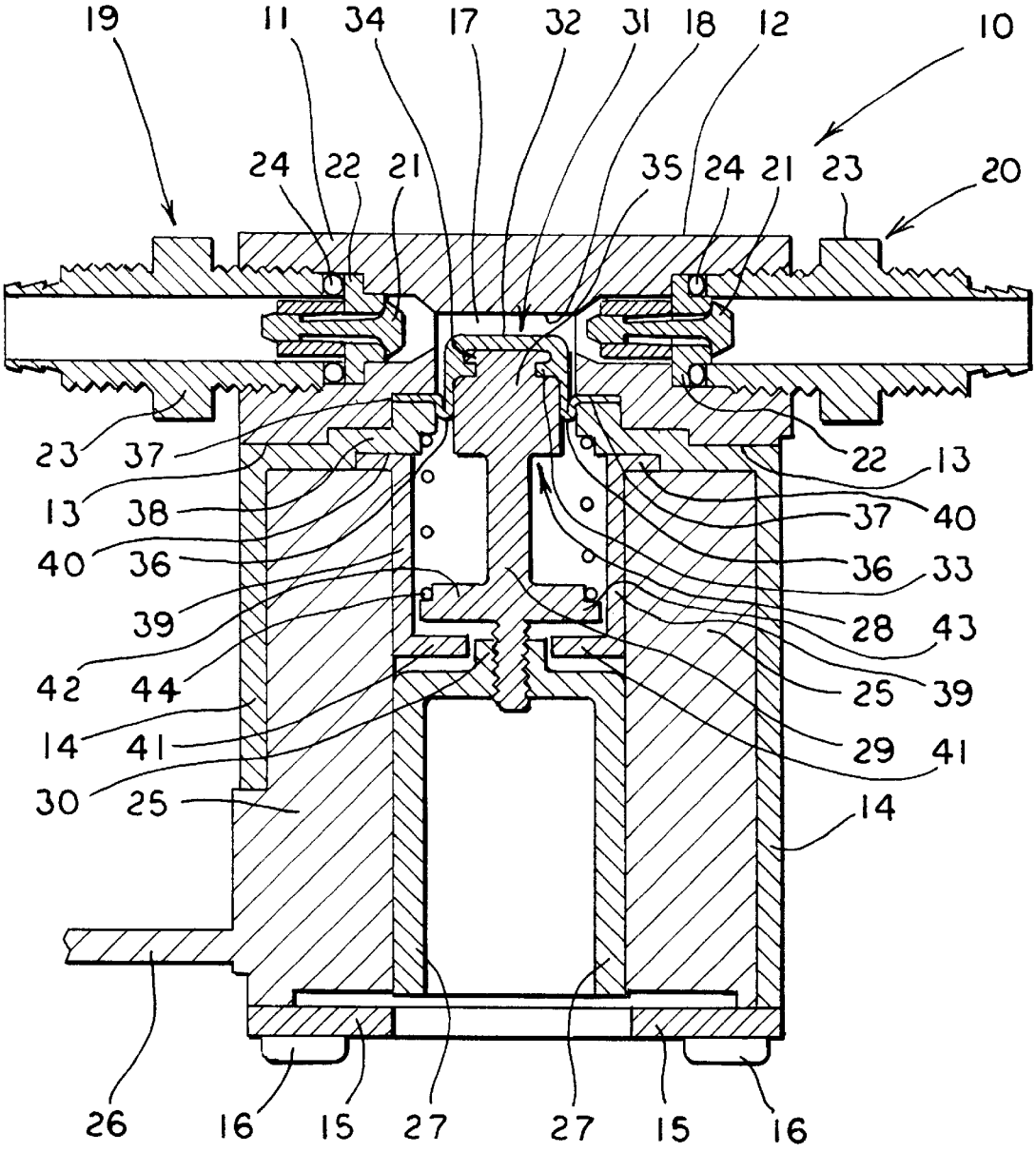
FIG. 1 is somewhat schematic cross section of a pump made in accordance with the present invention showing the stroking plunger in the neutral position.
Figure 2:
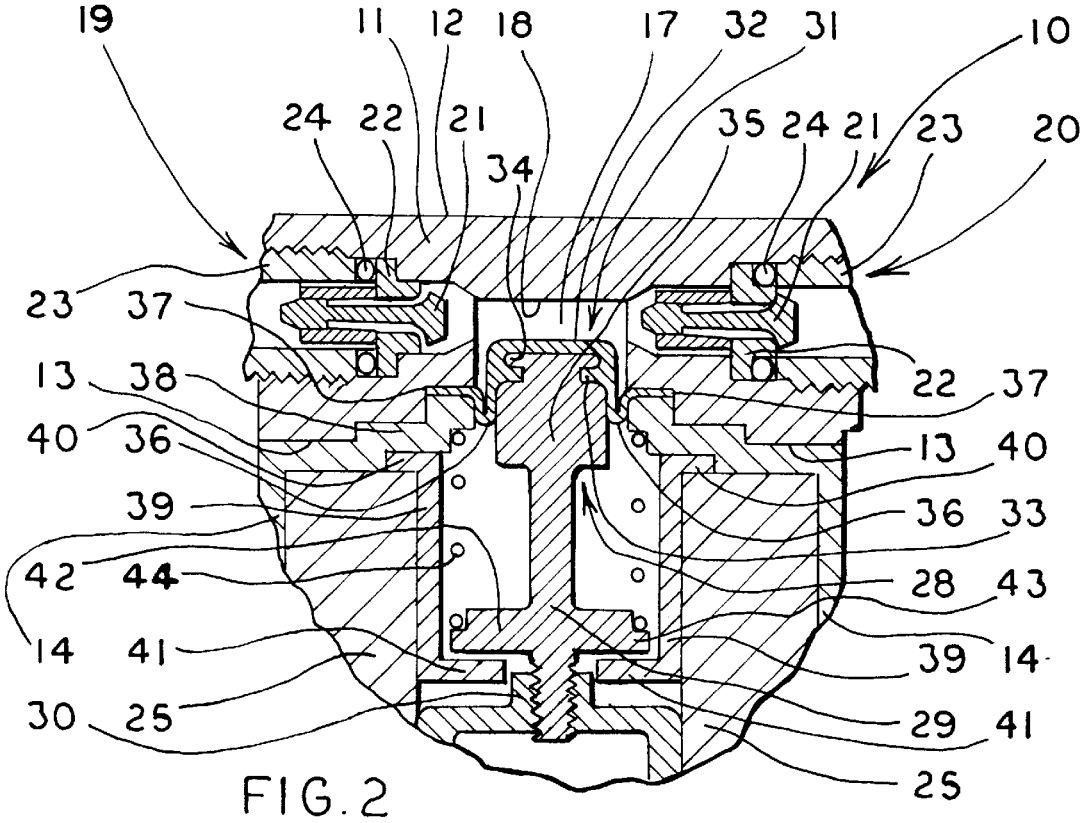
FIG. 2 is a fragmentary view similar to FIG. 1 but showing the plunger in the fully down position to draw fluid into the pump.
Figure 3:
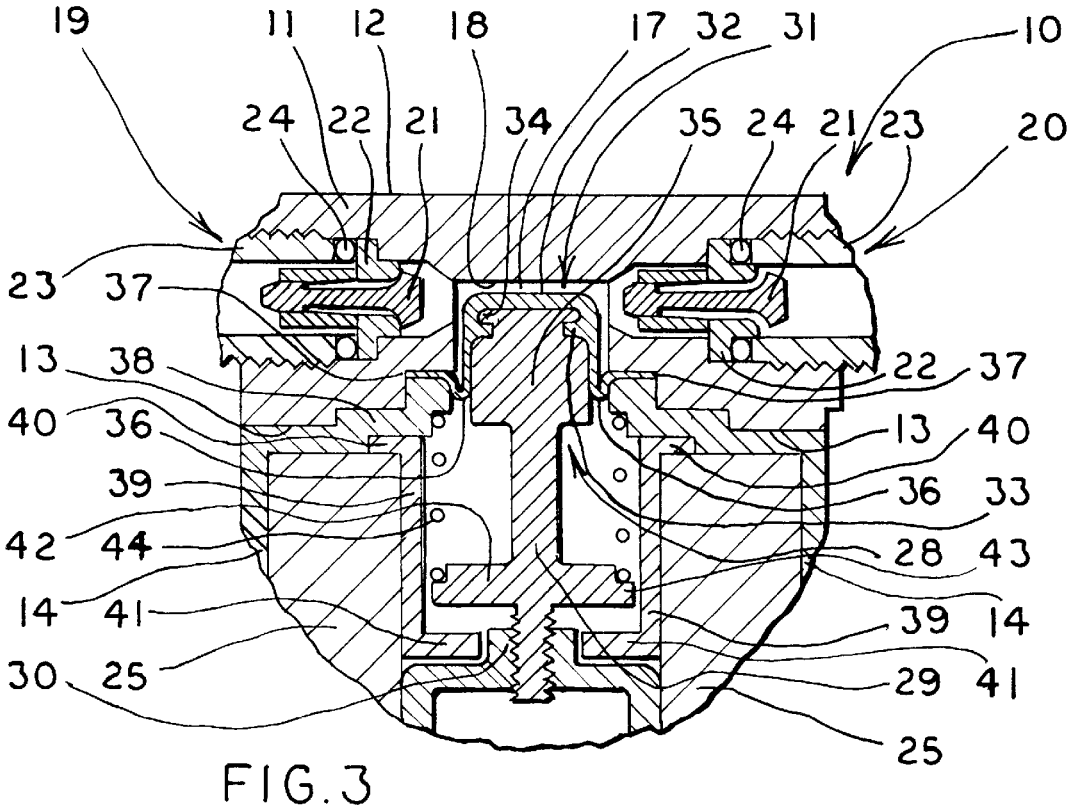
FIG. 3 is a fragmentary view similar to FIGS. 1 and 2 but showing the plunger in the fully up position to discharge fluid from the pump.

One embodiment of a pump made in accordance with the concepts of the present invention is shown in FIGS. 1–3 and is indicated generally by the numeral 10. Pump 10 includes a valve body 11 which at one end 12 forms the top of pump 10 and at the other stepped end 13 is connected by suitable fasteners (not shown) to one end of coil adapter 14. An end cap 15 is connected to the other end of coil adapter 14, as by fasteners 16. Preferably, end cap 15 is toroidal in shape having a central opening. Together, valve body 11, coil adapter 14 and end cap 15 form a pump housing.

The pump housing forms a pump chamber 17 defined on one end by an upper wall 18 formed in valve body 11, wall 18 being opposed and generally parallel to top wall 12. The sides of chamber 17 communicate with radially aligned fluid inlet and fluid outlet areas which respectively carry an inlet valve assembly, generally indicated by the numeral 19, and an outlet valve assembly generally indicated by the numeral 20. Valve assemblies 19 and 20 are essentially identical and are shown as including a conventional poppet valve 21 which is positionable on a valve seat 22 to close the valve assembly or positionable away from the valve seat 22 to allow fluid to pass through the valve assembly. Each valve assembly 19, 20 also includes a connector 23 which is threaded into valve body 11 and is adapted to receive a hose or other conduit to provide fluid to inlet valve assembly 19 and take fluid away from outlet valve assembly 20. An o-ring 24 may be provided between each valve seat 22 and each connector 23.

Although the valve assemblies 19 and 20 are shown as including conventional poppet valves 21, the exact type of valve employed is not critical to the present invention. In fact, most any type of alternative valves, such as, umbrella valves, duckbill valves, flapper valves, check valves, or the like could be utilized in the present invention. Moreover, although the inlet and outlet areas are shown as being in line and communicating with opposite sides of chamber 17, such is not a requirement of the present invention. Rather, for example, the fluid flow could enter chamber 17 radially and leave axially through a valve assembly received in top wall 12 of valve body 11, or vice-versa. Similarly, the fluid could both enter and exit chamber 17 through top wall 12 without departing from the concepts of the present invention.

A conventional toroidal-shaped electromagnetic coil assembly 25 is received within coil adapter 14 and is provided with electrical A.C. power via cord 26. An armature 27 is positioned within coil assembly 25, and, as is well known in the art, armature 27 reciprocates (upwardly and downwardly as oriented in the drawings) in response to the energization and de-energization of coil assembly 25. While armature 27 can be confined within end cap 15, when end cap 15 is provided with the central aperture previously described, when armature 27 reciprocates, a portion of it could extend out through the aperture in end cap 15.

A plunger assembly, generally indicated by the numeral 28, is carried by armature 27. To that end, one end of plunger assembly 28 is formed with a threaded shaft 29 which is received by a collar 30 formed at the upper end of armature 27. The fluid flow of pump 10 can be controlled by the extent to which shaft 29 is threaded into collar 30.

The other end of plunger assembly 28 carries a diaphragm generally indicated by the numeral 31. Diaphragm 31 can be a conventional elastomeric member having a central portion 32 which is received in chamber 17. Central portion 32 can include a lip 33 which engages a flange 34 formed near the end of the head 35 of the plunger assembly 28 such that plunger assembly 28 engages diaphragm 31. Diaphragm 31 then extends along the sides of the head 35 of plunger assembly 28, and it folds back on itself to form a convolution, as at 36, all around head 35 of plunger assembly 28. The ends 37 of diaphragm 31 are captured between a step of stepped surface 13 of valve body 11 and a corresponding step of a stepped surface 38 formed at the top of coil adapter 14. It should be noted that diaphragm 31 thus seals chamber 17. That is, no seals are necessary between valve body 11 and coil adapter 14, nor are any seals required between coil adapter 14 and end cap 15. Although when using poppet valves 21, -rings 24 are desirable, for certain other types of valves contemplated by the present invention, such as umbrella/duckbill valves, no 0-rings are necessary and diaphragm 31 thus provides the only seal in the entire pump 10.

A spring retainer 39 is received on the inside of coil assembly 25 above armature 27 and is maintained in position by virtue of its circumferential lip 40 being retained between a step of stepped surfaces 13 of valve body 11 and a mating step of stepped surfaces 38 of coil adapter 14. A torus-shaped stop surface 41 is formed at the other end of retainer 39 and, as shown in FIG. 3, dependent on the length of the stroke of armature 27, its collar 30 may extend up through stop surfaces 41.

A circular plate 42 having a circumferential tab 43 is formed on plunger assembly 28, plate 42 being positioned on shaft 29 above the threaded end thereof and below plunger head 35. Plunger assembly 28 also includes a coil spring 44 which extends between a step of stepped surface 38 of adapter 14 and tab 43 of plunger assembly 28 to bias plunger assembly 28 away from wall 18 of chamber 17 and toward stop surface 41 of retainer 39.

In operation of pump 10, at the point of starting, plunger assembly 28 can be in its neutral position, as shown in FIG. 1. Upon activation of coil assembly 25, armature 27 and plunger assembly 28 move upwardly to the FIG. 3 position, overcoming the bias of spring 44 to force fluid in chamber 17 out of valve assembly 20. It should be noted, however, that as shown in FIG. 3, plunger 28, and in particular diaphragm portion 32, do not touch or otherwise contact wall 18 of chamber 17. As would be evident to one of ordinary skill in the art, the range of travel of armature 27, and thus plunger assembly 28, is a function of the power level on the coil assembly 25, the mass of the armature 27 and plunger 28, and the power of spring 44. A balance of these factors prohibits the plunger 28 and diaphragm portion 32 from contacting wall 18 and creating an undesirable noise. In actuality, since half wave rectified voltage is preferably being applied to coil assembly 25, this noise, or chattering, would be repeated sixty times per second were plunger assembly 28 allowed to contact wall 18.

During the other half cycle, power to coil assembly 25 is off. At this time, under the influence of spring 44, plunger assembly 28 is moved to the extreme down position shown in FIG. 2. As a result, a partial vacuum is created in chamber 17 causing valve assembly 19 to open, thereby drawing fluid into chamber 17. As should be evident to one skilled in the art, by balancing the force of the spring, as discussed above, the movement of plunger assembly 28 can be controlled so that stop surface 41 is not contacted by plate 42 upon the intake stroke.

Pump 10 shown in FIGS. 1–3 will thus run silently during normal operating conditions. However, it is possible that during initial priming of the pump, or in other start-up situations where the fluid in chamber 17 may be a gas (air), the balance created in the pump of FIGS. 1–3 may not be able to prevent operating noise during priming. That is, in this situation, it is possible that plunger assembly 28 could engage stop surface 41 on the downstroke.

Figure 4:
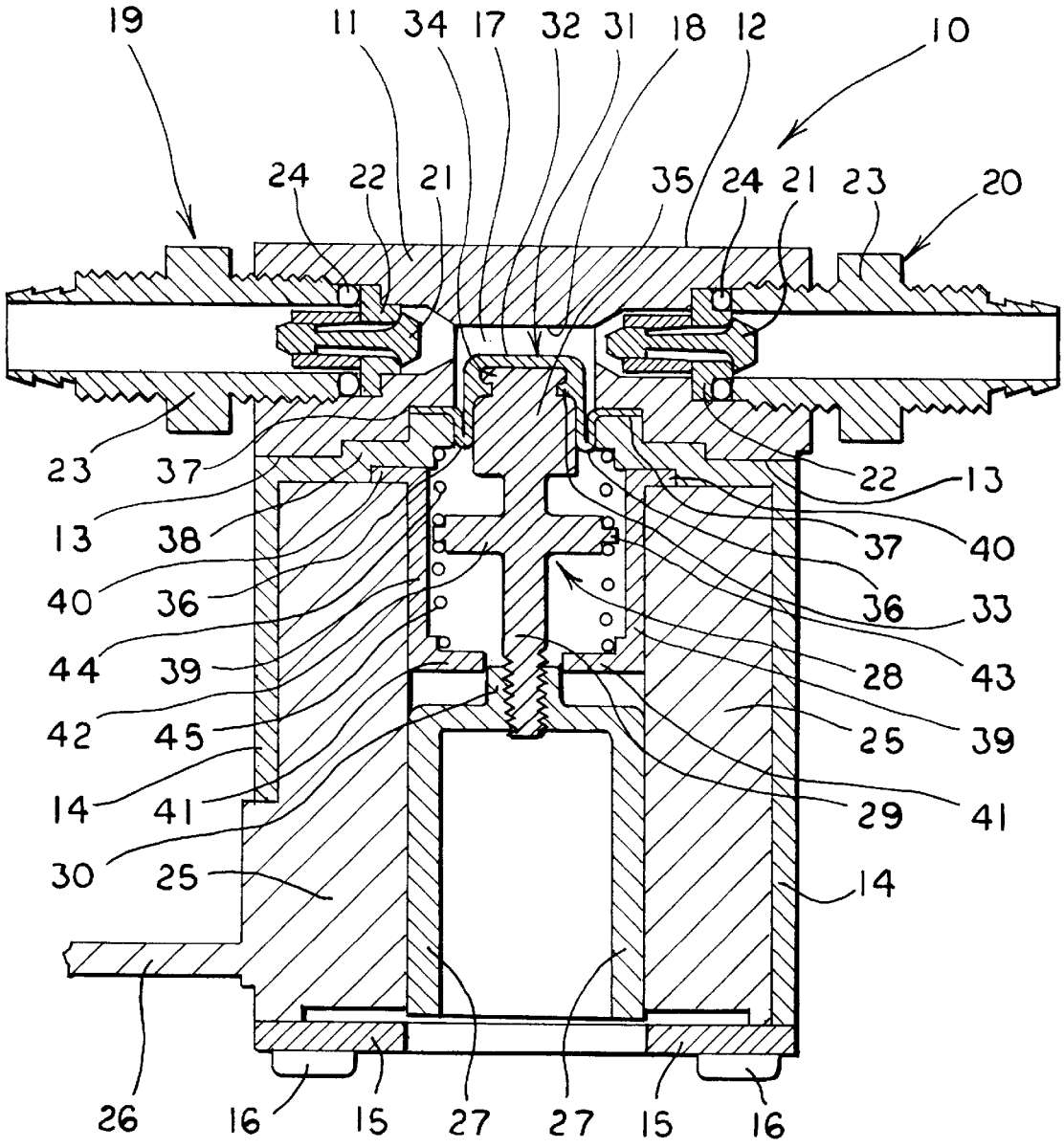
FIG. 4 is a somewhat schematic cross section of a pump made in accordance with another embodiment of the present invention showing the stroking plunger in the neutral position.
Figure 5:
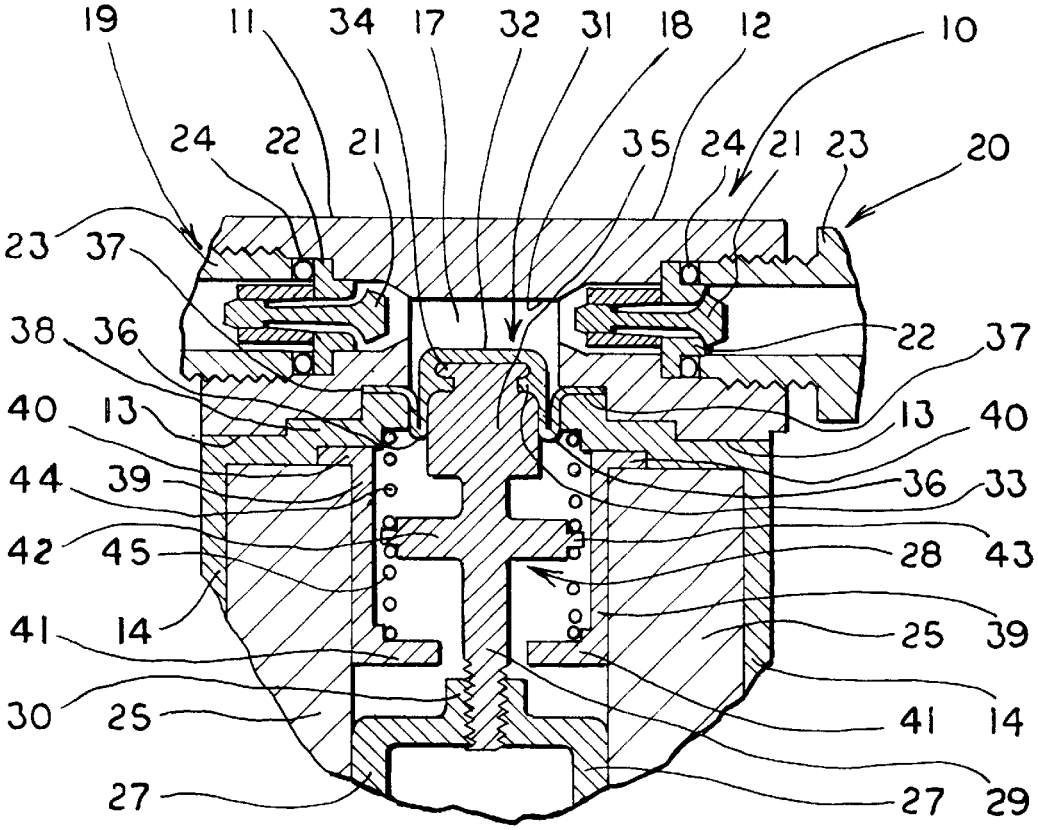
FIG. 5 is a fragmentary view similar to FIG. 4 but showing the fully down position to draw fluid into the pump.
Figure 6:
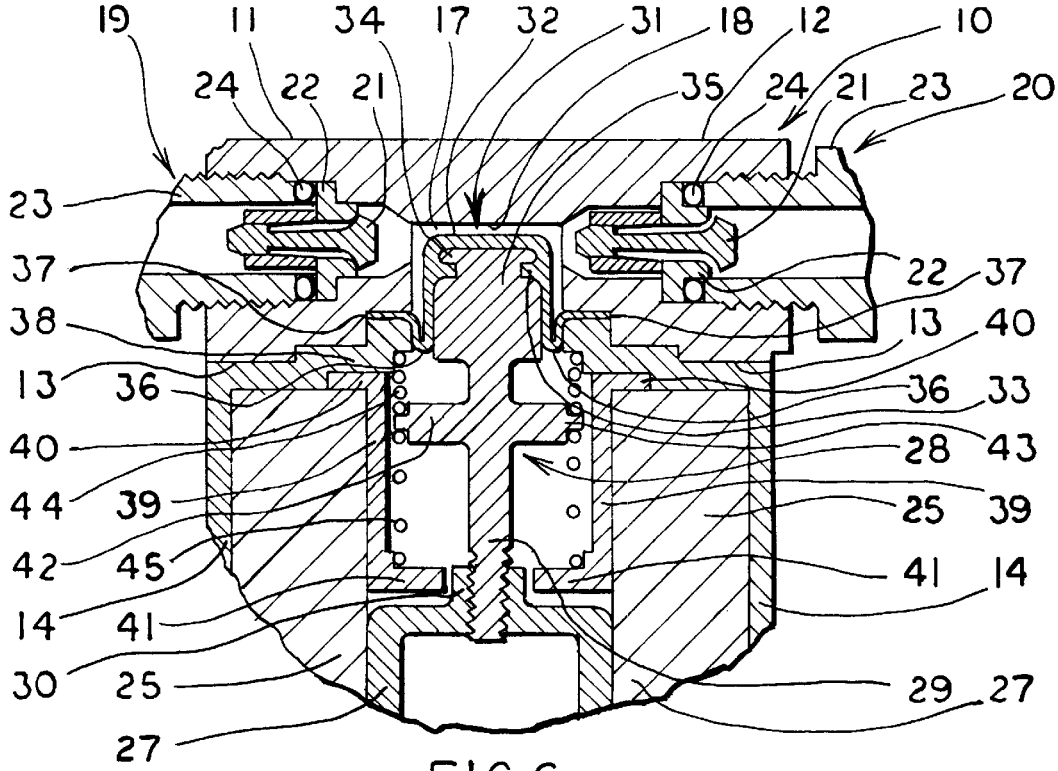
FIG. 6 is a fragmentary view similar to FIGS. 4 and 5 but showing the plunger in the fully up position to discharge fluid from the pump.

Such a possibility may be prevented by the embodiment of the pump 10 shown in FIGS. 4–6. This embodiment is essentially identical to that shown in FIGS. 1–3, and therefore, the same reference numerals have been applied to the same elements, and the description thereof relative to FIGS. 1–3 is equally applicable to the embodiment of FIGS. 4–6. However, in the FIGS. 4–6 embodiment, plate 42 of plunger assembly 28 is positioned on shaft 29 further from the threaded end thereof, and a second coil spring 45 is positioned between tab 43 and stop surface 41. Spring 45 thus biases plunger assembly 28 toward wall 18 of chamber 17 and will prevent plate 42 from contacting stop surface 41 in those versions of pump 10 whereby the armature 27 may be allowed to pass through end cap 15. If the end cap 15 is closed, spring 45 will prevent armature 27 from engaging it.

Thus, the addition of spring 45 can be offered if the user is concerned about silent running during priming. However, its presence should also be taken into consideration during the normal pumping operation. That is, during the discharge stroke when pump 10 is moving to the FIG. 6 position, spring 45 is acting in concert with coil assembly 25 against spring 44, and during the intake stroke when pump 10 is moving to the FIG. 5 position, the fact that spring 44 must overcome the force of spring 45 must be considered when balancing the system, as would be well known to one of ordinary skill in the art.

Thus, with or without spring 45, during normal pumping conditions, pump 10 is running silent to continuously pump fluid from the inlet valve area, through chamber 17, and through the outlet valve area. As a result, a pump 10 constructed as described herein substantially improves the art and otherwise accomplishes the objects of the present invention.

What is claimed is:

1. A pump comprising a housing, a pump chamber in said housing defined by at least one wall, an inlet area having a valve allowing fluid to be received in said chamber, an outlet area having a valve allowing fluid to be discharged from said chamber, an armature, a plunger carried by said armature, a stop surface adjacent to one end of said plunger, means to bias said plunger toward said stop surface, a diaphragm carried by the other end of said plunger and sealing said chamber, and an electromagnetic coil which when activated moves said armature to overcome the force of said means to bias so that said diaphragm is moved into said chamber without engaging said wall to discharge fluid through said outlet area, and upon deactivation of said coil, said means to bias moves said plunger toward said stop surface without engaging said stop surface to draw fluid through said inlet area and into said chamber.

2. The pump of claim 1 further comprising means to bias said plunger away from said stop surface.

3. The pump of claim 1 wherein said plunger includes a threaded shaft and said armature includes a collar to receive said shaft, the extent of threading of said shaft into said collar controlling the amount of fluid flow.

4. The pump of claim 1 further comprising a retainer member carried by said housing, said stop surface being a portion of said retainer member.

5. The pump of claim 4 wherein said plunger includes a plate and further comprising a spring positioned between said plate and said stop surface.

6. The pump of claim 5 wherein said plate includes a circumferential tab, said spring being positioned between said tab and said stop surface.

7. The pump of claim 1, said plunger having a head including a flange, said diaphragm being positioned on said head and having a lip received in said flange.

8. The pump of claim 7, said diaphragm having ends engaged by said housing to seal said chamber.

9. The pump of claim 1 wherein said housing includes a valve body carrying said valves and having said chamber, a coil adapter carrying said coil and attached to said body, and an end cap attached to said coil adapter.

10. The pump of claim 9 wherein said diaphragm has ends carried between said valve body and said coil adapter.

11. The pump of claim 9 wherein said plunger includes a plate, and said means to bias includes a spring extending between said plate and said coil adapter.

12. The pump of claim 11 wherein said plate includes a circumferential tab, said spring being positioned between said tab and said stop surface.

13. The pump of claim 11 further comprising a second spring extending between said plate and said stop surface.

14. The pump of claim 12 further comprising a second spring extending between said tab and said stop surfaces.

15. The pump of claim 9 further comprising a retainer having a portion positioned between said valve body and said coil adapter, said retainer including said stop surface.

* * * * *